United States Patent [19]

DeParales et al.

[11] 4,183,443

[45] Jan. 15, 1980

[54] REUSABLE CUP COVER

[76] Inventors: Lawrence T. DeParales, 1 Gates Rd., Marshfield, Mass. 02050; Edward P. Billitzer, 24 Water St. East, Weymouth, Mass. 02189

[21] Appl. No.: 936,798

[22] Filed: Aug. 25, 1978

[51] Int. Cl.[2] ..... A47G 19/22

[52] U.S. Cl. ..... 220/90.4; 222/548; 222/557; 222/560

[58] Field of Search ..... 220/90.4, 254, 345, 220/336; 222/548, 557, 560, 512

[56] References Cited

U.S. PATENT DOCUMENTS

| | | | |
|---|---|---|---|
| 1,756,249 | 4/1930 | Kaufman | 220/90.4 |
| 1,963,766 | 6/1934 | Stewart | 222/548 |
| 2,111,480 | 3/1938 | Pawlitschek | 220/336 |
| 2,358,194 | 9/1944 | White | 220/336 |
| 2,975,946 | 3/1961 | Westgate | 222/548 |
| 3,058,630 | 10/1962 | Abt | 222/548 |
| 3,164,286 | 1/1965 | Kole | 220/336 |
| 3,542,260 | 11/1970 | Souza | 222/548 |
| 3,703,979 | 11/1972 | Douty | 220/336 |

*Primary Examiner*—Ro E. Hart

[57] ABSTRACT

A reusable cup cover having two separable parts for washing and mating in such a way that a segmented portion is slidably arranged to seal the top of the cup cover by means of a users thumb operation to enable the user to drink from the covered cup and reseal between drinks with a lockable tab.

1 Claim, 3 Drawing Figures

REUSABLE CUP COVER

Disposable cup covers are numerous and are used in restaurants and other food dispensing organizations wherein the user purchases coffee or other drinks and the cup cover is applied to a disposable cup. The disposable cup cover obviously is inexpensive and lacks many of the amenities that a permanent cup cover that is reusable would have. The first of these, of course, are that the cup cover does not have sufficient insulation to keep the drink warm or cold. The disposable cup cover does not provide a substantial enough seal to enable one to drink from the cup and reseal it as desired, confident that the drink contained within the cup will not leak out or escape, nor will any impurities enter the cup. Accordingly, the present inventors have discovered that a cup cover which is resealable and slightly more expensive than a disposable cup cover, but reusable is needed by people who are constantly on the road, or in a factory or similar places with unfavorable environments would desire a cup cover of their own to replace disposable cup covers over cups with drinks that they may purchase at a restaurant or vendor unable to supply such an expensive cup cover. Such a cup cover is also useful by campers and the like especially in association with a more permanent cup.

In order to provide a cup cover that is reusable, it was found that it must be of substantial thickness in order to provide the necessary installation to prevent the contents of a cup from getting cold too rapidly. In addition the part that is movable to enable one to open the cup to drink from it without removing the entire cup cover has to be separable from the remaining part of the cup cover in order to be washed thoroughly and in a sanitary manner. The fabrication of two separate segments which mate with one another were also found desirable in fabrication of the ultimate cup cover.

In order for the segment which is openable to properly seal, it was discovered that a rotably sliding seal was most desirable because the sliding seal provided a gradual pressure on the segment between it and the cover and provided a tight seal preventing the escape or entry of any unwanted materials. It was also discovered that a overhanging portion at one edge would provide a latching type action once the segment was in a tight sealing position, would be held there to prevent the unwanted movement of the segment by jarring the cup.

Therefore an object of the present invention is to provide a reusable cup cover having a removable segment, which reseals the cup cover between drinks, to permit the cover to be easily washed for reuse.

Another object of this invention is to provide a reusable washable cup cover having a rotatable sliding seal between a removable segment and the cup cover.

Another object of the present invention is to provide a locking arrangement in a reusable washable cup cover having a sliding seal between the removable segment and the cup cover.

Other objects, features and advantages of the present invention will be better understood from the following detailed specification, especially when read in conjunction with the attached drawings of which:

Figure 1:
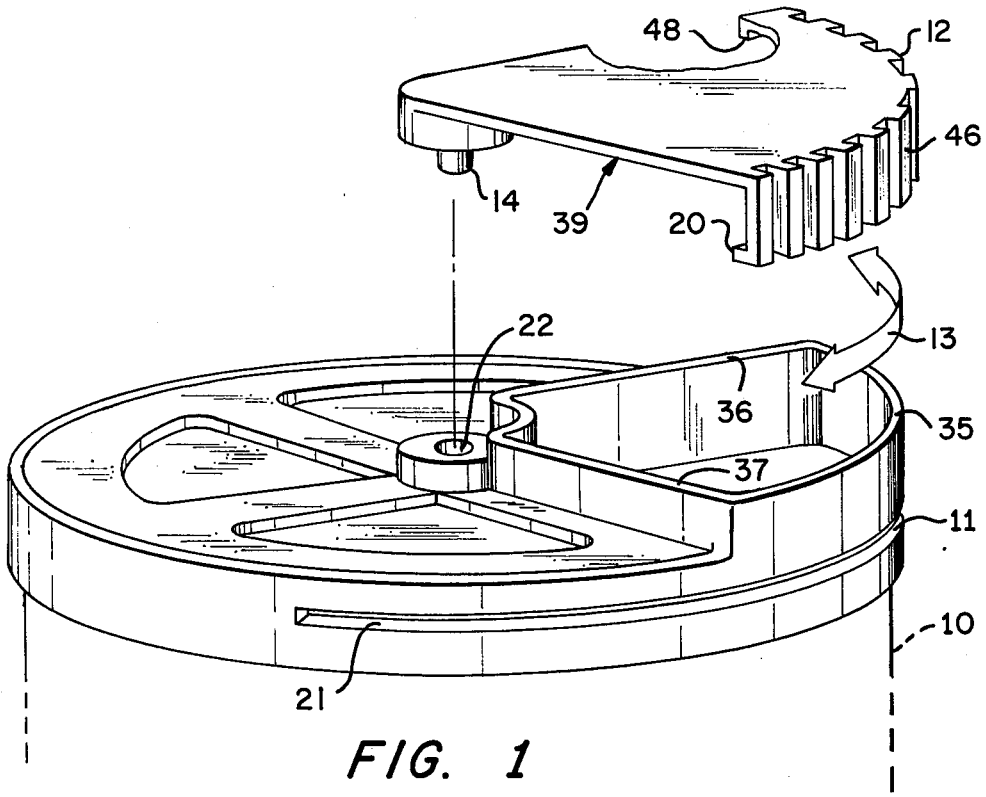
FIG. 1 is the present invention with its movable segment above the cup cover.

Referring now to FIG. 1 we see the reusable cup cover 11 placed over a disposable cup 10. This could also be a reusable cup. The lip of the opening 35 is that which the user puts to his lips as he drinks from the cup. The movable segment 12 slides along track 21. Its expanded portion 14 is insertable into hole 22 where it snaps in place. When installed the segment is placed at the end there is no opening and it is pushed in by thumb; section 20 slides into slot 21. The plastic is yieldable so the parts fit together rather easily. The underneath surface of the segment 12 is marked 39, and slides over the edges of 37, 35 and 36 such that a tight sliding seal is provided when the operator pushes the knurled portion 46 with his thumb in either direction indicated by arrow 13.

It is seen that the cup cover can be fabricated in two segments; taken apart cleaned, and reassembled at will. A lip 48 holds the unit closed. 48 extends over the cup lid in the closed position only. This provides a latching action as the operator slides the segment to the closed position. As it gets to one particular point, the yieldable plastic snaps into place providing a latching action which requires additional pressure on the part of the operator to cause the segment to move, opening the cup cover for drinking purposes. Drinking from the cup is controllable by means of the movement of segment 12 with its knurled edge 46.

The cup is shown as a disposable one. It is conceivable that a permanent cup could be substituted with this cover and be reused time and again.

Figure 2:
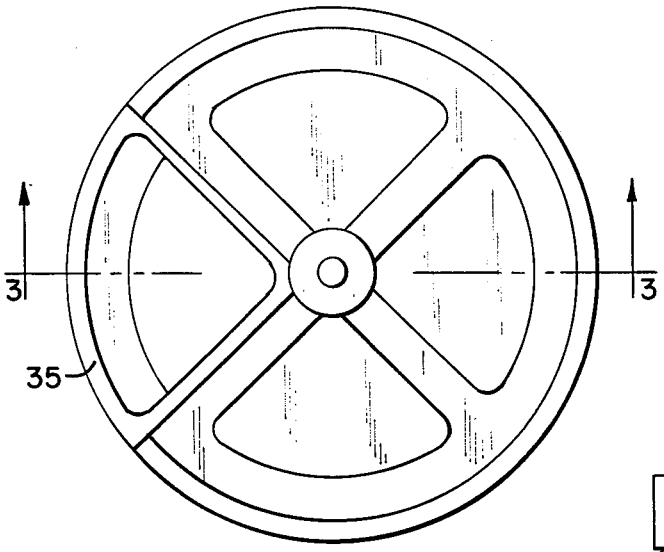
FIG. 2 is a top view of the present invention.

Referring now to FIG. 2 we see the cup from the top. We note that it has the usual reinforcing ribs to increase its strength. The opening segment is removed. We can see the opening with its edge 35 which comes in contact with the user's mouth for drinking purposes.

Figure 3:
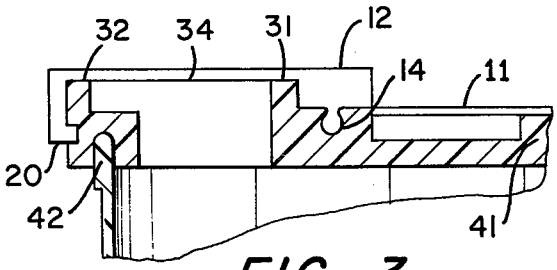
FIG. 3 is a sectional view of the complete cup cover on a cup.

Referring now to FIG. 3 we see the cup cover and cup in section. The rim of the cup 42 is shown circumferencial mating within the cover at 41. The lip 20 of the opening segment is shown in slot 21 in the cup cover. The drinking edge 32 and the opposing edge 31 is shown with the underneath surface 30 of the opening segment covering (in a very tight fashion) the opening. The opening segment has a tip 14 (which is yieldable plastic) is insertable into the opening center 22 in the cup cover, and is free to rotate in there and yet is held tightly in place by means of the pressure of the expanded plastic against the side walls of the opening.

It is seen that this cup cover is made of plastic which can be of substantial thickness to provide insulation, such that the contents of the cup remains warm or cold, as the case may be. Moreover, we note that the movable segment 12 can be removed from the cover, washed, and can be reassembled. We also note that the cup cover can be operated by the users thumb. Therefore, when he is driving along he can snap it open with a little additional pressure beyond the latch until he is fully open, drink from the cup, and return the segment back to its latching position, and place it down assurred that the contents of the cup will not leak out. Moreover, in dirty environments, such as may be found in factories and other places, the user can be secure in knowing that his cup cover will not permit the entry of any foreign material (even bugs) which would be very undesirable. It is seen that this cup cover may cost more than the disposable kind, however, it is washable and reusable. When a user buys a cup of coffee at the local restaurant, can take out his cup cover and place it on the cup, take the coffee with him in his automobile, or where ever, and enjoy his coffee without having it spilled. The additional investment is spread over so many usages that it therefore becomes less expensive than the disposable kind.

Although we have described our invention with reference to specific apparatus, we do not wish to be limited thereby, we only wish to be limited by the appended claims:

We claim:

1. A reusable cup cover comprising in combination with a cup, a cup cover having a perimeter for mating with a disposable cup, a concentric opening for receiving an expandable tip, an arcuate slot running along the perimeter below its upper edge, a pie shaped opening to permit drinking from the cup through the cover, having three slightly sloping surfaces upwardly in a preselected arcuate direction, and a segment for covering the cover opening having an expandable tip for mating with the concentric hole in said cover, a lip for slidably interfitting said arcuate slot along said cup perimeter, a sloping undersurface to sealably mate with the edges of said cover opening, means for latching said segment closed when the cover is placed in its closed position.

* * * * *